US006016774A

United States Patent [19]

Bokkers et al.

[11] Patent Number: 6,016,774

[45] **Date of Patent: *Jan. 25, 2000**

[54] TOTAL COOLING ASSEMBLY FOR A VEHICLE HAVING AN INTERNAL COMBUSTION ENGINE

[75] Inventors: Ron Bokkers, Delaware; Alex Joseph, Komoka, both of Canada; Bjorn Rossing, Vallda, Sweden

[73] Assignee: Siemens Canada Limited, Mississauga, Canada

[ * ] Notice: This patent is subject to a terminal disclaimer.

[21] Appl. No.: 09/105,634

[22] Filed: Jun. 26, 1998

Related U.S. Application Data

[60] Continuation-in-part of application No. 08/834,395, Apr. 16, 1997, Pat. No. 5,845,612, which is a division of application No. 08/576,390, Dec. 21, 1995, Pat. No. 5,660,149

[60] Provisional application No. 60/051,247, Jun. 30, 1997.

[51] Int. Cl.[7] ..... F01P 7/16; F01P 5/12

[52] U.S. Cl. ..... 123/41.1; 123/41.12; 123/41.44; 123/41.49; 165/DIG. 306; 165/DIG. 316

[58] Field of Search ..... 123/41.01, 41.02, 123/41.08, 41.09, 41.11, 41.12, 41.44, 41.49, 41.1; 165/DIG. 306, DIG. 316

[56] References Cited

U.S. PATENT DOCUMENTS

| | | | |
|---|---|---|---|
| 1,284,177 | 11/1918 | Camden . | |
| 1,911,522 | 5/1933 | McIntyre . | |
| 1,992,795 | 2/1935 | Young | 257/137 |
| 2,286,398 | 6/1942 | Young | 257/259 |
| 2,420,436 | 5/1947 | Mallory | 123/178 |
| 3,096,818 | 7/1963 | Evans et al. | 165/111 |
| 3,795,274 | 3/1974 | Fieni | 165/122 |
| 4,369,738 | 1/1983 | Hirayama | 123/41.1 |
| 4,381,736 | 5/1983 | Hirayama | 123/41.1 |
| 4,423,705 | 1/1984 | Morita et al. | 123/41.02 |
| 4,437,749 | 3/1984 | Morita et al. | 123/41.02 |

(List continued on next page.)

FOREIGN PATENT DOCUMENTS

| | | |
|---|---|---|
| 0 584 850A1 | 3/1994 | European Pat. Off. . |
| 2 455 174 | 11/1980 | France . |
| 4117214A1 | 12/1992 | Germany . |

*Primary Examiner*—Willis R. Wolfe
*Assistant Examiner*—Brian Hairston

[57] ABSTRACT

A total cooling assembly adapted for installation in an engine compartment of an I.C. engine vehicle. The assembly includes a heat exchanger module to transfer heat from fluid coolant to air entering the air flow path and having front and rear faces such that air can pass in heat exchange relation across the heat exchanger module to absorb heat from fluid coolant flowing through the heat exchanger module. The heat exchanger module includes an inlet and an outlet. A cooling fan module carries the heat exchanger module and includes a fan and an electric fan motor for drawing air across the heat exchanger module from the front face to the rear face of the heat exchanger module. Pump structure is carried by the cooling fan module to circulate fluid coolant. The pump structure has at least one pump and an electric motor driving the pump. A cooling circuit is provided in which fluid coolant is circulated by the action of the pump structure. The cooling circuit permits the fluid coolant to move from the pump structure to the engine. An outlet of the engine is constructed and arranged to communicate fluid coolant with the inlet to the heat exchanger module. The outlet of the heat exchanger module is fluidly connected with an inlet to the pump structure to return the fluid coolant to the pump structure. The cooling circuit includes bypass structure constructed and arranged to fluidly connect an outlet of the engine with an inlet to the pump structure. Valve structure is provided in the cooling circuit to regulate flow therethrough. A controller controls operation of the at least one electric motor of the pump structure, the electric fan motor, and the valve structure. During a warm-up operating condition of the engine, the bypass structure permits fluid coolant to flow from the outlet of the engine to the inlet of the pump structure while substantially preventing fluid coolant to flow through the heat exchanger module.

15 Claims, 3 Drawing Sheets

U.S. PATENT DOCUMENTS

| | | | |
|---|---|---|---|
| 4,539,942 | 9/1985 | Kobayashi et al. | 123/41.1 |
| 4,557,223 | 12/1985 | Gueyen | 123/41.12 |
| 4,580,531 | 4/1986 | N'Guyen | 123/41.1 |
| 4,685,513 | 8/1987 | Longhouse et al. | 165/121 |
| 4,726,325 | 2/1988 | Itakura | 123/41.1 |
| 4,768,484 | 9/1988 | Scarselletta | 123/41.21 |
| 4,930,455 | 6/1990 | Creed et al. | 123/41.1 |
| 5,002,019 | 3/1991 | Klaucke et al. | 123/41.49 |
| 5,036,803 | 8/1991 | Nolting et al. | 123/41.1 |
| 5,046,554 | 9/1991 | Iwasaki et al. | 165/140 |
| 5,079,488 | 1/1992 | Harms et al. | 318/471 |
| 5,201,285 | 4/1993 | McTaggart | 123/41.31 |
| 5,215,044 | 6/1993 | Banzhaf et al. | 123/41.29 |
| 5,242,013 | 9/1993 | Couetoux et al. | 165/121 |
| 5,390,632 | 2/1995 | Ikebe et al. | 123/41.02 |
| 5,482,010 | 1/1996 | Lemberger et al. | 123/41.1 |
| 5,522,457 | 6/1996 | Lenz | 165/121 |
| 5,537,956 | 7/1996 | Rennfeld et al. | 123/41.29 |
| 5,597,038 | 1/1997 | Potier | 165/121 |
| 5,619,957 | 4/1997 | Michels | 123/41.44 |
| 5,660,149 | 8/1997 | Lakerdas et al. | 123/41.44 |
| 5,845,612 | 10/1998 | Lakerdas et al. | 123/41.44 |

TOTAL COOLING ASSEMBLY FOR A VEHICLE HAVING AN INTERNAL COMBUSTION ENGINE

This application is a continuation-in-part of Ser. No. 08/834,395, filed Apr. 16, 1997, now U.S. Pat. No. 5,845,612, which is a division of Ser. No. 08/576,390, filed Dec. 21, 1995, now U.S. Pat. No. 5,660,149 this application claims the benefit of U.S. Provisional Application No. 60/051,247, filed Jun. 30, 1997.

FIELD OF THE INVENTION

This invention relates to a cooling assembly and more particularly to a total cooling system that includes various pump and valve configurations to provide efficient fluid circulation and heat rejection in an engine compartment of an internal combustion engine of a vehicle.

BACKGROUND OF THE INVENTION

An internal combustion engine requires heat rejection generally either by air or liquid. In conventional vehicles, liquid cooled engines are most common. Liquid engine cooling is accomplished by an engine-driven coolant pump (commonly referred to as a water pump) mounted on the engine block and operated directly by the engine. The pump forces coolant through passages in the engine, where the coolant absorbs engine heat, then the coolant passes through a radiator where heat is rejected, and finally coolant is returned to the pump inlet to complete the fluid circuit. A fan, driven either directly from the engine or by an electric motor, is used in many cases to draw ambient air across the radiator so that heat is rejected at the radiator by transferring heat from the coolant to the ambient air, thus cooling the engine.

A conventional thermostat controls the flow of pumped coolant through the radiator in relation to coolant temperature. The thermostat controls flow through the radiator until the coolant reaches a sufficiently hot temperature to cause the thermostat to allow flow through the radiator such that the radiator may effectively limit engine temperature. In this way, the thermostat performs a form of coolant temperature regulation that establishes a desired operating temperature for the engine once the engine has fully warmed up while inherently allowing the coolant to heat more rapidly when the engine is started from a cooler condition.

Although the above described cooling system is effective in operation, to improve fuel economy, it is preferable to operate the cooling fan and water pump motor based on cooling requirements, rather than on the r.p.m. of the engine.

A need exists to provide a total cooling system incorporating at least one electric coolant pump-motor and an electric fan motor which operate independent of engine r.p.m. and wherein cooling is optimized based on current draw of the coolant pump-motor.

SUMMARY OF THE INVENTION

An object of the invention is to fulfill the need referred to above. In accordance with the principles of the present invention, this objective is obtained by providing a total cooling assembly adapted for installation in an engine compartment of an automotive vehicle and defining an air flow path. The vehicle has an internal combustion engine. The assembly includes a heat exchanger module constructed and arranged to transfer heat from fluid coolant to air entering the air flow path and having front and rear faces such that air can pass in heat exchange relation across the heat exchanger module to absorb heat from fluid coolant flowing through the heat exchanger module. The heat exchanger module includes an inlet and an outlet. A cooling fan module carries the heat exchanger module and includes a fan and an electric fan motor for drawing air across the heat exchanger module from the front face to the rear face of the heat exchanger module. Pump structure is carried by the cooling fan module to circulate fluid coolant. The pump structure has at least one pump and an electric motor driving the pump. A cooling circuit is provided in which fluid coolant is circulated by the action of the pump structure. The cooling circuit permits the fluid coolant to move from the pump structure to the engine. An outlet of the engine is constructed and arranged to communicate fluid coolant with the inlet to the heat exchanger module. The outlet of the heat exchanger module is fluidly connected with an inlet to the pump structure to return the fluid coolant to the pump structure. The cooling circuit includes bypass structure constructed and arranged to fluidly connect an outlet of the engine with an inlet to the pump structure. Valve structure is provided in the cooling circuit to regulate flow therethrough. A controller controls operation of the at least one electric motor of the pump structure, the electric fan motor, and the valve structure. During a warm-up operating condition of the engine, the bypass structure permits fluid coolant to flow from the outlet of the engine to the inlet of the pump structure while substantially preventing fluid coolant to flow through the heat exchanger module.

Other objects, features and characteristics of the present invention, as well as methods of operation and functions of related elements of the structure, and the combination of the parts and economics of manufacture, will become more apparent upon consideration of the detailed description and appended claims with reference to the accompanying drawings, all of which form a part of the specification.

DETAILED DESCRIPTION OF THE PREFERRED EMBODIMENTS

Figure 1:
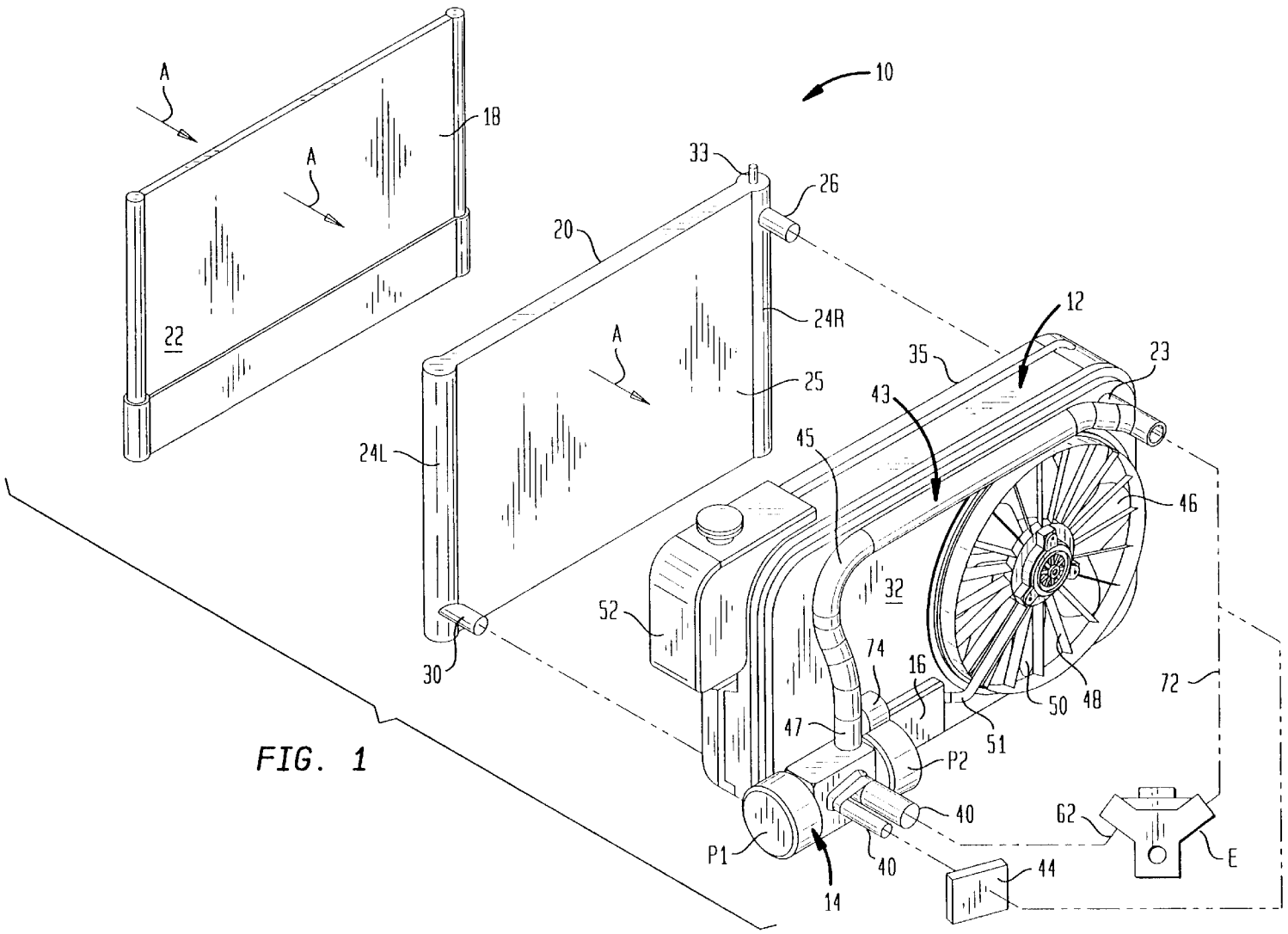
FIG. 1 is an exploded perspective view of a first exemplary embodiment of a total cooling assembly provided in accordance with the principles of the present invention.

With reference to FIG. 1 a total engine cooling assembly, generally indicated 10, for an internal combustion engine is shown, provided in accordance with the principles of the present invention. The internal combustion engine is schematically illustrated and designated by the letter E. In an exploded perspective view from the upper left rear, the cooling assembly 10 comprises a cooling fan module, generally indicated at 12, an electric coolant pump structure, generally indicated at 14, an electronic systems control module 16, and a heat exchanger module, generally indicated at 18. As shown in FIG. 1, the pump structure 14 and the electronic systems control module 16 are carried by the cooling fan module 12. In addition, when assembled for employment in a front engine compartment of an automotive vehicle powered by the engine E, the heat exchanger module 18 is joined with the cooling fan module 12 by suitable joining means, such as fasteners, to form the total cooling assembly 10.

The heat exchanger module 18 comprises a radiator 20 and, when air conditioning is provided, an air conditioning condenser 22 is disposed adjacent to the radiator 20. Radiator 20 is conventional, comprising right and left side inlet header tanks 24R and 24L, and a core 25 disposed between the two header tanks 24R, 24L. The right side header tank 24R is an inlet tank and includes an inlet tube 26 at an upper end thereof The inlet tube 26 is fluidly coupled with a T-type connector 28 of the pump structure 14, the function of which will become apparent below. The left side header tank 24L is an outlet tank and includes an outlet tube 30 near lower end thereof which is fluidly connected to an inlet (not shown) of the pump structure 14.

In the embodiment of FIG. 1, the pump structure 14 comprises first and second pump-motors P1 and P2, respectively, each having a pump being driven by an associated electric motor. Pump-motor P2 has an inlet 29 (FIG. 2) fluidly connected to the outlet tube 30 of the heat exchanger module 18. The pump-motor P2 is fluidly connected to pump-motor P1 and pump-motor P1 includes an outlet 40 fluidly coupled with the internal combustion engine E at inlet 62, and fluidly connected to a heater core 44. In accordance with the principles of the present invention, bypass structure, generally indicated at 43, is provided which includes a hose 45 coupled to a return inlet 47 of the pump-motor P1, and the T-type connector 28. Valve structure 74 is provided in the bypass structure for controlling flow therethrough. As noted above, inlet 26 of the radiator 20 is fluidly connected to one end of the T-type connector 28. The other end of the T-type connector 28 is fluidly coupled to the engine E, the function of which will be explained below.

The cooling fan module 12 comprises a panel structure 32 having a size corresponding generally to the size of the heat exchanger module 18. The pump structure 14 and the electronic systems control module 16 are coupled to the panel structure 32. In the illustrated embodiment, an axial flow fan structure is provided and comprises a fan 46 and an electric motor 48 coupled to the fan 46 to operate the fan 46. Fan 46 is disposed concentrically with a surrounding circular-walled through opening 50 in the panel structure 32. An expansion tank 52 is mounted on the cooling fan module 12 to receive, from connector 33 of the right header tank and via tube 35, coolant during certain operating conditions.

Radiator 20 and condenser 22 each define a heat exchanger serving to reject heat to ambient air. Engine coolant, in the case of the engine cooling system, and refrigerant, in the case of the air conditioning system, flow through passageways and their respective heat exchangers while ambient air flows across the passageways from the front face to the rear face of the heat exchanger module 18, in a direction of arrows A in FIG. 1. The air passes successively through the condenser 22 and the radiator 20. Each heat exchanger (condenser 22 and radiator 20) typically is constructed with fins, corrugations, or other means to increase the effective heat transfer surface area of the passageways for increasing heat transfer efficiency. The flow of ambient air across the heat exchanger module 18 forms an effluent stream, with such flow being caused either by the operation of the fan 46 by motor 48 to draw air across the heat exchanger module 18 or by a ram air effect when the vehicle is in forward motion, or a combination of both.

The electronic systems control module 16 receives electric power from the vehicle electrical system and also various signals from various sources. Module 16 comprises electronic control circuitry that acts upon the signals to control the operation of electric motors of the pump-motors P1 and P2, fan motor 48 and to control the operation of the valve structure 74 and heater valve 68. Since control module 16 operates the fan 46 and pump structure 14 at speeds based on cooling requirements rather than engine r.p.m., engine power is used more efficiently and thus, fuel economy is improved. Examples of other signal sources controlled by the control module 16 include temperature and/or pressure sensors located at predetermined locations in the respective cooling and air conditioning systems, and/or data from an engine management computer, and/or data from an electronic data bus of the vehicle's electrical system. The control module 16 includes a controller or microprocessor which processes signals and/or data from the various sources to operate the pump-motors and fan such that the temperature of coolant, in the case of the engine cooling system, and the pressure of refrigerant, in the case of the air conditioning system, are regulated to the desired temperature and pressures, respectively.

Figure 2:
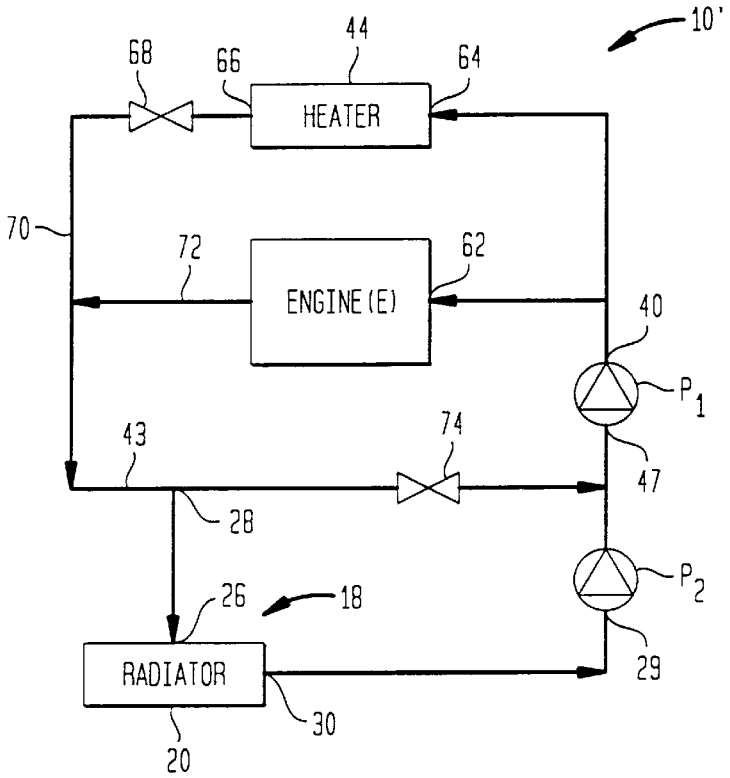
FIG. 2 is a schematic fluid circuit of the total cooling assembly of FIG. 1.

FIG. 2 is a schematic illustration of the total cooling system 10 of FIG. 1. As shown, the pump structure 14 comprises the two pump-motors, P1 and P2. An outlet 40 of the pump of the pump-motor P1 fluidly communicates with an inlet 62 of the engine E. In addition, an outlet 40 of the pump of pump-motor P1 communicates with an inlet 64 of the heater core 44. An outlet 66 of heater core 44 is in communication with a heater valve 68 which communicates via connecting line 70 with fluid exiting the engine via flow path 72. Connecting line 70 is in fluid communication with the bypass structure 43. The T-type connector 28 permits coolant to flow through to the radiator inlet 26 and also to valve 74 disposed in the bypass structure 43 and return to the pump-motor P1. Valve 74 is preferably a two-way variable flow control valve movable between open and closed positions at any point in between so as to open or close the bypass structure 43. The outlet 30 of the radiator 20 is directed to the second pump-motor P2 and the second pump-motor P2 is in fluid communication with the pump of pump-motor P1. The pump-motors P1 and P2 are conventional and are provided so that a single high power pump-motor generally of higher cost need not be provided. Further, flow of coolant can be controlled easier with two smaller pump-motors than with one large pump-motor.

Another advantage of employing the two-pump-motors PI and P2 of the embodiment of FIG. 2, is that the total cooling assembly may include a built-in "limp-home" fail safe feature. Thus, in the two pump-motor design, if one pump-motor fails, the other pump-motor will ensure that fluid may pass around the failed pump-motor via a pump bypass circuit having a pressure relief valve. The pressure relief valve will ensure that the coolant passes to the engine to protect the engine. The controller of the control module 16 will have logic built-in to control this feature and to alert the driver of the vehicle to bring the vehicle to a service center.

If the valve associated with the bypass structure fails, a default , closed valve condition is established such that all coolant passes through the radiator circuit.

In a first option of the embodiment of FIG. 2, pump-motors P1 and P2 each has a two-speed brush motor. Pump-motor P1 preferably operates at 300 W and 120 W while pump-motor P2 preferably operates at 450 W and 150 W. In a second option, the pump-motors P1 and P2 each has a brushless motor, with pump-motor P1 operating at 300 W, while pump-motor P2 operates at 450 W. Finally, in a third option, pump-motor P1 has a two-speed brush motor operating at 300 W and 120 W while pump-motor P2 has a brushless motor operating at 450 W.

TABLE 1 shows flow rates through the radiator 20, heater core 44 and bypass structure 46 at operating conditions for option 1, wherein pump-motors P1 and P2 each have a two speed brush motor. As shown, at warm-up, valve 74 in the bypass structure 43 is open and generally no flow is permitted through the radiator 20 since flow is restricted at pump-motor P2 which is not in operation. During operating conditions other than warm-up, both pump-motors P1 and P2 are in operation. The current draw is shown in the table for each operating condition. It is noted that only 0.3 l/s is required through the radiator 20 at idle and at 70 Kph for heat balance, but the low speed of the pump motors forces 2.0 l/s.

TABLE 1

| Operating Condition | Q (Kw) | Circuit Flow (l/s) Rad. | Bypass | Htr | Tot Eng Flow (l/s) | Delta P (Kpa) P1 | P2 | Flow (l/s) P1 | P2 | Inp Power (W) P1 | P2 | Current Draw (A) |
|---|---|---|---|---|---|---|---|---|---|---|---|---|
| Warm Up 0 Kph | | 0.0 | 1.6 | 0.0 | 1.6 | 31 | 0 | 1.6 | 0.0 | 120 | 0 | 9.2 |
| Idle 0 Kph | 8.0 | 2.0 | 0.0 | 0.0 | 2.0 | 48 | 32 | 2.0 | 2.0 | 120 | 150 | 20.8 |
| 70 Kph | 25.0 | 2.0 | 0.6 | 0.0 | 2.6 | 75 | 32 | 2.6 | 2.0 | 120 | 150 | 20.8 |
| Trailer + grade 90 Kph | 35.0 | 2.0 | 0.2 | 0.0 | 2.2 | 58 | 32 | 2.2 | 2.0 | 300 | 150 | 34.6 |
| H. Speed 240 Kph | 50.0 | 2.5 | 0.0 | 0.0 | 2.5 | 50 | 75 | 2.5 | 2.5 | 300 | 450 | 57.7 |

TABLE 2 shows flow rates through the radiator 20, heater core 44 and bypass structure 46 at operating conditions for option 2, wherein pump-motors P1 and P2 each have a brushless motor. Again, at warm-up, valve 74 in the bypass structure 43 is open and generally no flow is permitted through the radiator 20 since flow is restricted at pump-motor P2 which is not in operation. During operating conditions other than warm-up, both pump-motors P1 and P2 are in operation. The current draw is shown in the table for each operating condition.

TABLE 2

| Operating Condition | Q (Kw) | Circuit Flow (l/s) Rad. | Bypass | Htr | Tot Eng Flow (l/s) | Delta P (Kpa) P1 | P2 | Flow (l/s) P1 | P2 | Inp Power (W) P1 | P2 | Current Draw (A) |
|---|---|---|---|---|---|---|---|---|---|---|---|---|
| Warm Up 0 Kph | | 0.0 | 0.5 | 0.0 | 0.5 | 3 | 0 | 0.5 | 0.0 | 4 | 0 | 0.3 |
| Idle 0 Kph | 8.0 | 0.3 | 0.5 | 0.0 | 0.8 | 8 | 1 | 0.8 | 0.3 | 16 | 1 | 1.3 |
| 70 Kph | 25.0 | 1.0 | 0.5 | 0.0 | 1.5 | 27 | 8 | 1.5 | 1.0 | 100 | 20 | 9.2 |
| Trailer + grade 90 Kph | 35.0 | 1.5 | 0.5 | 0.0 | 2.0 | 48 | 18 | 2.0 | 1.5 | 235 | 66 | 23.2 |
| A. Speed 240 Kph | 50.0 | 2.5 | 0.0 | 0.0 | 2.5 | 75 | 50 | 2.5 | 2.5 | 450 | 305 | 58.0 |

TABLE 3 shows flow rates through the radiator 20, heater core 44 and bypass structure 46 at operating conditions for option 3, wherein pump-motor P1 has a two-speed brush motor and pump-motor P2 has a brushless motor. At warm-up, valve 74 in the bypass structure 43 is open and generally no flow is permitted through the radiator 20 since flow is restricted at pump-motor P2 which is not in operation. During operating conditions other than warm-up, both pump-motors P1 and P2 are in operation.

TABLE 3

| Operating Condition | Q (Kw) | Circuit Flow (l/s) Rad. | Bypass | Htr | Tot Eng Flow (l/s) | Delta P (Kpa) P1 | P2 | Flow (l/s) P1 | P2 | Inp Power (W) P1 | P2 | Current Draw (A) |
|---|---|---|---|---|---|---|---|---|---|---|---|---|
| Warm Up 0 Kph | | 0.0 | 1.6 | 0.0 | 1.6 | 31 | 0 | 1.6 | 0.0 | 120 | 0 | 9.2 |
| Idle 0 Kph | 8.0 | 0.3 | 1.3 | 0.0 | 1.6 | 31 | 1 | 1.6 | 0.3 | 120 | 1 | 9.3 |
| 70 Kph | 25.0 | 1.0 | 0.6 | 0.0 | 1.6 | 31 | 8 | 1.6 | 1.0 | 120 | 20 | 10.8 |
| Trailer + grade 90 Kph | 35.0 | 2.0 | 0.2 | 0.0 | 2.2 | 58 | 32 | 2.2 | 2.0 | 315 | 156 | 36.2 |
| H. Speed 240 Kph | 50.0 | 2.5 | 0.0 | 0.0 | 2.5 | 50 | 75 | 2.5 | 2.5 | 315 | 450 | 58.8 |

Figure 3:
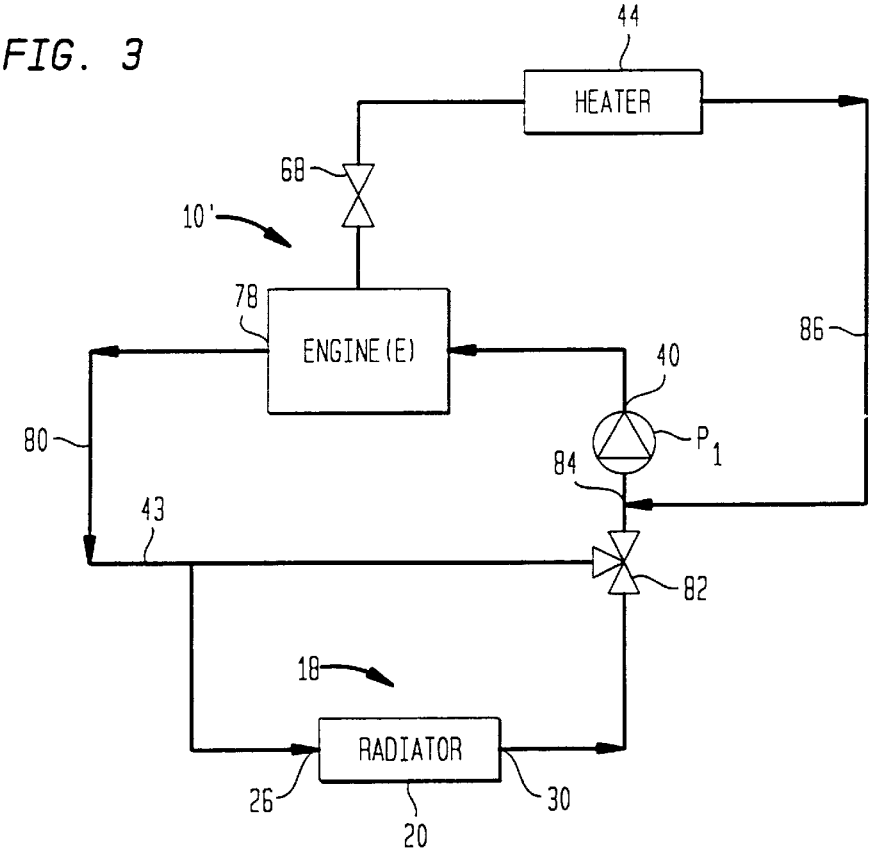
FIG. 3 is a schematic fluid circuit of a second embodiment of a total cooling assembly of the invention.

FIG. 3 is a schematic illustration of another embodiment of the total cooling system 10' of the invention. As shown, pump outlet 40 fluidly communicates with an inlet to the engine E and outlet 78 of the engine E communicates via a line 80 with the inlet 26 of the radiator 20. Outlet 78 also communicates with the bypass structure 43. Coolant flow through the bypass structure 43 is controlled by a three-way variable flow control valve 82. An outlet 30 of the radiator 20 communicates with the three-way valve 82 which in turn communicates with the inlet of the pump-motor P1. A heater core 44 communicates with an inlet 84 of the pump-motor P1 via line 86 and a heater valve 68 is disposed between the heater core and the engine E. In this embodiment, the pump-motor P1 preferably has a brushless motor which operates generally at 760 W. FIG. 3 represents a 36 volt system.

TABLE 4 shows flow rates through the radiator 20, heater core 44 and bypass structure 46 at operating conditions for the embodiment of FIG. 3, wherein the pump-motor P1 has a brushless motor and a three-way valve 82 is employed in the fluid circuit. As shown, at warm-up, the three- way valve 82 permits flow from the bypass to the pump-motor P1, but prevents flow through the radiator 20. Note that the current draw is much less than the two pump-motor embodiments in TABLES 1–3 since only one motor is need.

TABLE 4

| Operating Condition | Q (Kw) | Circuit Flow (l/s) Rad. | Bypass | Htr | Tot Eng Flow (l/s) | Delta P (Kpa) P1 | P2 | Flow (l/s) P1 | P2 | Inp Power (W) P1 | P2 | Current Draw (A) |
|---|---|---|---|---|---|---|---|---|---|---|---|---|
| Warm Up 0 Kph | | 0.0 | 0.5 | 0.0 | 0.5 | 4 | | 0.5 | | 5 | | 0.1 |
| Idle 0 Kph | 8.0 | 0.3 | 0.5 | 0.0 | 0.8 | 18 | | 0.5 | | 35 | | 1.0 |
| 70 Kph | 25.0 | 1.0 | 0.5 | 0.0 | 1.5 | 37 | | 1.5 | | 135 | | 4.0 |
| Trailer + grade 90 Kph | 35.0 | 2.0 | 0.5 | 0.0 | 2.0 | 71 | | 2.0 | | 345 | | 10.0 |
| H. Speed 240 Kph | 50.0 | 2.5 | 0.0 | 0.0 | 2.S | 138 | | 2.5 | | 840 | | 23.0 |

Figure 4:
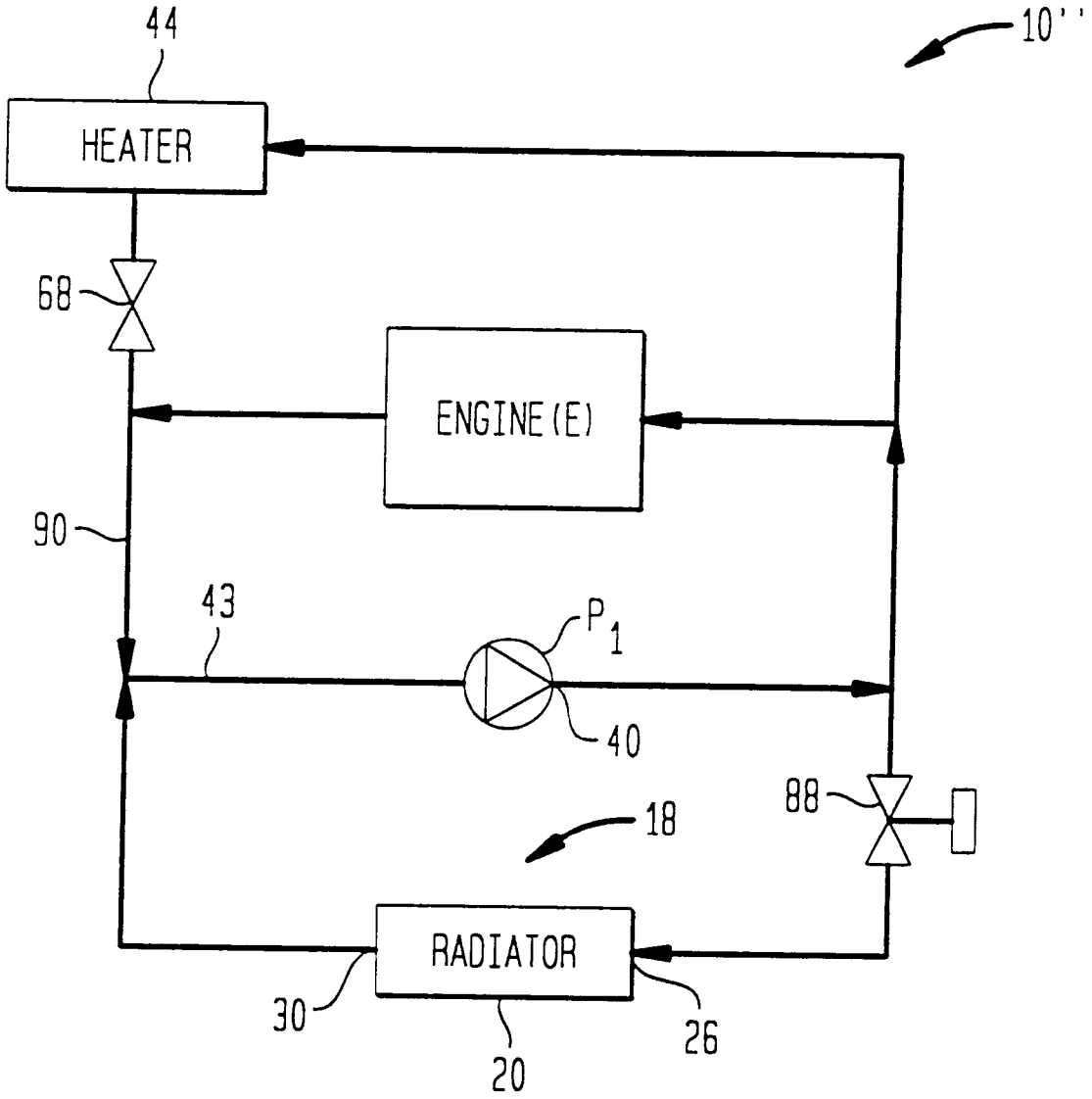
FIG. 4 is yet another embodiment of a fluid circuit of a total cooling assembly of the invention.

FIG. 4 is a schematic illustration of another embodiment of a total cooling system 10" of the invention. As shown, an outlet 40 of pump-motor P1 is in fluid communication with an inlet to engine E. In addition, an outlet of the pump of the pump-motor P1 is in fluid communication with the inlet 26 of radiator 20. A two-way variable flow control valve 88 is disposed between the pump-motor P1 and the radiator 20. An outlet of the engine E is fluidly connected to the bypass structure 43 via line 90, which is also connected to the outlet 30 of the radiator 20. As shown, the bypass structure 43 communicates with the pump-motor P1. Further, an outlet of the pump-motor P1 is in fluid communication with an inlet to the heater core 44. A heater valve 68 is disposed downstream of the heater core 44 and the outlet of the heater core 44 communicates with the pump-motor P1. Pump-motor P1 preferably has a brushless motor which operates at 640 W. FIG. 4 represents a 36 volt system.

TABLE 5 shows flow rates through the radiator 20, heater core 44 and bypass structure 46 at operating conditions for the embodiment of FIG. 4, wherein the pump-motor P1 has a brushless motor and a two-way valve 88 is provided in the fluid circuit. Again, at warm-up, valve 88 is closed such that no flow is permitted though the radiator.

TABLE 5

| Operating Condition | Q (Kw) | Circuit Flow (l/s) Radiator | Bypass | Heater |
|---|---|---|---|---|
| Warm Up 0 Kph | | 0.0 | 0.5 | 0.0 |
| Idle 0 Kph | 8.0 | 0.3 | 0.5 | 0.0 |
| 70 Kph | 25.0 | 1.0 | 0.5 | 0.0 |
| Trailer + grade 90 Kph | 35.0 | 2.0 | 0.5 | 0.0 |
| A. Speed 240 Kph | 50.0 | 2.5 | 0.0 | 0.0 |

For each embodiment as represented by TABLES 1–5, it is assumed that the pump of the pump structure 14 is approximately 60% efficient, and the motor which operates the pump of the pump structure 14 is approximately 68% efficient.

It can be appreciated that in the one pump-motor design, in the case of pump or motor failure, no coolant will be circulating and there is no "limp-home" feature. However, to protect the engine, the controller of control module 16 will alert the driver to shut-off the engine immediately to prevent permanent engine damage.

Motors of the pump-motors P1 and P2, and the motor 48 to operate the fan 46 are typically DC motors compatible with the typical DC vehicle electrical system. The electrical current flowing to each motor is controlled by respective switches, solid-state or electromechanical, which are operated by control module 16, and may be internal to that module. FIG. 1 shows electric wiring 51 leading from control module 16 to the respective electric motors.

The total cooling system 10 is installed in vehicle by "dropping" it into the vehicle engine compartment and securing it in place. Various connections are then made such as connecting the fluid hoses and connecting the module 16 with the vehicle electrical system and with various signal sources mentioned above.

It can be seen that the total cooling system of the invention provides cooling based on cooling requirements and not based on engine r.p.m. Cooling is optimized based on the current draw of the coolant pump-motor selected.

While the presently preferred embodiments of the invention have been illustrated and described, it should be appreciated that other constructions and embodiments may fall within the spirit and scope of the following claims.

What is claimed is:

1. A total cooling assembly adapted for installation in an engine compartment of an automotive vehicle and defining an air flow path, the vehicle having an internal combustion engine, the assembly comprising:

a heat exchanger module constructed and arranged to transfer heat from fluid coolant to air entering the air flow path and comprising front and rear faces such that air can pass in heat exchange relation across said heat exchanger module to absorb heat from fluid coolant flowing through said heat exchanger module, said heat exchanger module including an inlet and an outlet;

a cooling fan module carrying said heat exchanger module and comprising fan and an electric fan motor for drawing air across said heat exchanger module from said front face to said rear face of said heat exchanger module;

pump structure carried by said cooling fan module to circulate fluid coolant, said pump structure having at least one pump and an electric motor driving said pump;

a cooling circuit in which fluid coolant is circulated by the action of said pump structure, said cooling circuit permitting the fluid coolant to move from said pump structure to the engine, an outlet of said engine being constructed and arranged to communicate fluid coolant with the inlet to said heat exchanger module, the outlet of said heat exchanger module being fluidly connected with an inlet to said pump structure to return the fluid coolant to said pump structure, said cooling circuit including bypass structure fluidly constructed and arranged to connect an outlet of the engine with an inlet to said pump structure;

valve structure in said cooling circuit to regulate flow therethrough such that during a warm-up operating condition of the engine, said valve structure is controlled to permit fluid coolant flow from the outlet of the engine through said bypass structure and to the inlet of the pump structure, while substantially preventing fluid coolant to flow through said heat exchanger module; and a controller to control operation of said at least one electric motor of said pump structure, said electric fan motor, and said valve structure.

2. The assembly according to claim 1, further comprising a heater core and a valve associated with said heater core, said heater core being constructed and arranged to receive the fluid coolant and to return the fluid coolant to said pump structure.

3. The assembly according to claim 1, wherein said valve structure is a two-way variable flow control valve disposed in bypass structure between an outlet of the engine and an inlet to said pump structure so as to control flow between the outlet of the engine and said inlet to said pump structure.

4. The assembly according to claim 1, wherein said valve structure is a three-way variable flow control valve operatively associated with said bypass structure to control flow between an outlet of the engine and an inlet of said pump structure and between an outlet of said heat exchanger module and an inlet to said pump structure.

5. The assembly according to claim 1, wherein said valve structure is a two-way variable flow control valve disposed between an outlet of said pump and an inlet to said heat exchanger module.

6. The assembly according to claim 3, wherein said pump structure comprises first and second pump-motors, said first pump-motor being disposed upstream of said two position valve and downstream of an inlet to the engine, and said second pump-motor being disposed upstream of an outlet of said heat exchanger module and downstream of said first pump-motor.

7. The assembly according to claim 6, wherein a motor of each of said first and second pump-motors is a two-speed brush motor.

8. The assembly according to claim 6, wherein a motor of each of said first and second pump-motors is a brushless motor.

9. The assembly according to claim 6, wherein a motor of said first pump-motor is a brush motor and a motor of said second pump-motor is a brushless motor.

10. The assembly according to claim 4, wherein said pump structure comprises a single pump-motor, a motor of said pump-motor being a brushless motor.

11. The assembly according to claim 5, wherein said pump structure comprises a single pump-motor, a motor of said pump-motor being a brushless motor.

12. The assembly according to claim 1, wherein said controller is an electronics control module carried by said cooling fan module.

13. The assembly according to claim 1, wherein said heat exchanger module comprises a radiator and a condenser.

14. The assembly according to claim 1, wherein said cooling fan module includes panel structure, said panel structure having an opening therethrough, said fan being mounted within said opening, said pump structure and said controller being mounted on said panel structure.

15. The assembly according to claim 1, wherein if one of said pump-motors fails, said controller is constructed and arranged to control operation of the other pump-motor to ensure that coolant is directed to the engine.

* * * * *